United States Patent [19]

Scheurecker

[11] 4,109,700

[45] Aug. 29, 1978

[54] ARRANGEMENT FOR INTRODUCING A FLEXIBLE STARTER BAR INTO A CONTINUOUS CASTING PLANT

[75] Inventor: Werner Scheurecker, Linz, Austria

[73] Assignee: Vereinigte Osterreichische Eisen-und Stahlwerke - Alpine Montan Aktiengesellschaft, Linz, Austria

[21] Appl. No.: 776,540

[22] Filed: Mar. 11, 1977

[30] Foreign Application Priority Data

Mar. 23, 1976 [AT] Austria ..... 2112/76

[51] Int. Cl.[2] ..... B22D 11/08

[52] U.S. Cl. ..... 164/426

[58] Field of Search ..... 164/274, 425, 426, 434, 164/435–448

[56] References Cited

U.S. PATENT DOCUMENTS 3,817,316 6/1974 Koch et al. ..... 164/274

FOREIGN PATENT DOCUMENTS 2,318,158 10/1974 Fed. Rep. of Germany ..... 164/274

4,301 2/1973 Japan ..... 164/274

37,815 9/1972 Japan ..... 164/274

*Primary Examiner*—Francis S. Husar

*Assistant Examiner*—John S. Brown

*Attorney, Agent, or Firm*—Brumbaugh, Graves, Donohue & Raymond

[57] ABSTRACT

An arrangement for introducing a flexible starter bar with a starter bar head from above into a continuous casting plant including a mould, a strand guide and an introduction part and has a lifting mechanism for the starter bar, a transporting car. The transporting car contains a sliding or roller path having arcuate end parts for transporting the starter bar to the introduction part and a conveying device for the starter bar provided on the transporting car. The conveying device is designed as a displacement car and is movable on the transporting car in the longitudinal direction of the sliding or roller path for introducing the starter bar into the introduction part. First and second catches are provided on the displacement car for engagement with the starter bar.

10 Claims, 7 Drawing Figures

ARRANGEMENT FOR INTRODUCING A FLEXIBLE STARTER BAR INTO A CONTINUOUS CASTING PLANT

BACKGROUND OF THE INVENTION

The invention relates to an arrangement for introducing a flexible starter bar, having a starter bar head into a continuous casting plant from above. The arrangement includes a lifting mechanism for gripping and lifting the starter bar and a transporting car provided with a sliding or roller path, which starter bar can be brought to the introduction part of the strand guide by the transporting car.

An arrangement of this kind is already known (German Offenlegungsschrift No. 2,318,158), in which the starter bar is introduced into the strand guide by means of a driving stand fastened to the transporting car via the sliding or roller path which is provided with an arcuate end part. The difficulty with this design is that the lifting cable provided with a receiving hook at its end for gripping the starter bar has to pass the driving stand, and furthermore a separate returning means having a separate drive is necessary for returning and lowering the receiving hook together with the lifting cable. For introducing and lowering the starter bar, substantial pressure forces from the driving rolls are necessary. Finally, the driving stand which encloses the starter bar near its end portion when the starter bar is lying on the transporting car, makes it difficult to get access to the starter bar, and the lifting mechanism makes it difficult to get access to the mould.

According to another suggestion (German Auslegeschrift No. 1,961,443), the starter bar is transported to the mould by a car that is movable on the casting platform in a continuous casting plant. The car carries an endless conveyor belt guided over deflection rollers, which conveyor belt introduces the starter bar into the mould. This arrangement requires a comparatively great construction height corresponding to the diameter of the deflection rollers, thereby limiting the accessability of the starter bar. Beside the transporting car, a separate lifting means for lifting a cassette enclosing the starter bar and a turning means for turning the cassette before the starter bar is delivered to the transporting car are necessary.

SUMMARY OF THE INVENTION

The invention aims at avoiding the above-described disadvantages and difficulties and has as its object to provide an arrangement for introducing a starter bar from above into a continuous casting plant without the need for a turning means and a cassette. Also the starter bar and the mould are to be freely accessible before the starter bar is introduced into the strand guide. Further the apparatus is to have a simple and operationally safe construction, in which the hook tackle, i.e. the receiving hook and its fastening means on the lifting cable, need not be deflected to the horizontal sliding or roller path, but is always guided in the vertical position and does not require a separate return means.

According to the invention, in an arrangement of the above-defined kind, this object is achieved in that for introducing the starter bar into the introduction part, a displacement means is movable on a transporting car in the longitudinal direction of a sliding or roller path also contained on the transporting car, which displacement means is engageable with the starter bar by a catch.

Suitably the displacement means is designed as a conveying car which is displaceable on rails of the transporting car.

According to a preferred embodiment the lifting means is united with the displacement means. In this manner the same drive means can be used for the lifting means and for the displacement means.

According to a further preferred embodiment, the displacement means is displaceable along the horizontal sliding or roller path between: a starting position A at the rear end of the transporting car, in which position the foot end of the starter bar has been lifted to the level of the sliding or roller path; a position B at the front end of the transporting car, in which position the hook can be unlatched from the engagement position; a further position C at the rear end of the transporting car, in which position the catch can be engaged in the head end of the starter bar; and a final position D to be reached after a movement in the direction toward the mould at the front end of the transporting car, in which final position the foot end of the starter bar is gripped by the driven rollers of the strand guide.

Advantageously, the lifting means is provided with a hook fastened to a tie-bar, wherein the ends of the tie-bar are guided in a stationary guide. In the displacement means, a corresponding guide is provided, which corresponding guide accommodates the tie-bar together with the hook in the lifted position and which is movable together with the displacement means.

In the unlatch position B, advantageously a link or the like is provided on the sliding or roller path for pivoting up the last foot member of the starter bar.

Further preferred features of the invention include a stop on the displacement means to guard against a premature unlatching of the hook and lateral guiding elements, in particular vertical rollers provided along the sliding or roller path.

BRIEF DESCRIPTION OF THE DRAWINGS

The invention shall now be described by way of an exemplary embodiment and with reference to the accompanying drawings, wherein.

DESCRIPTION OF AN EXEMPLARY EMBODIMENT

Figure 1:
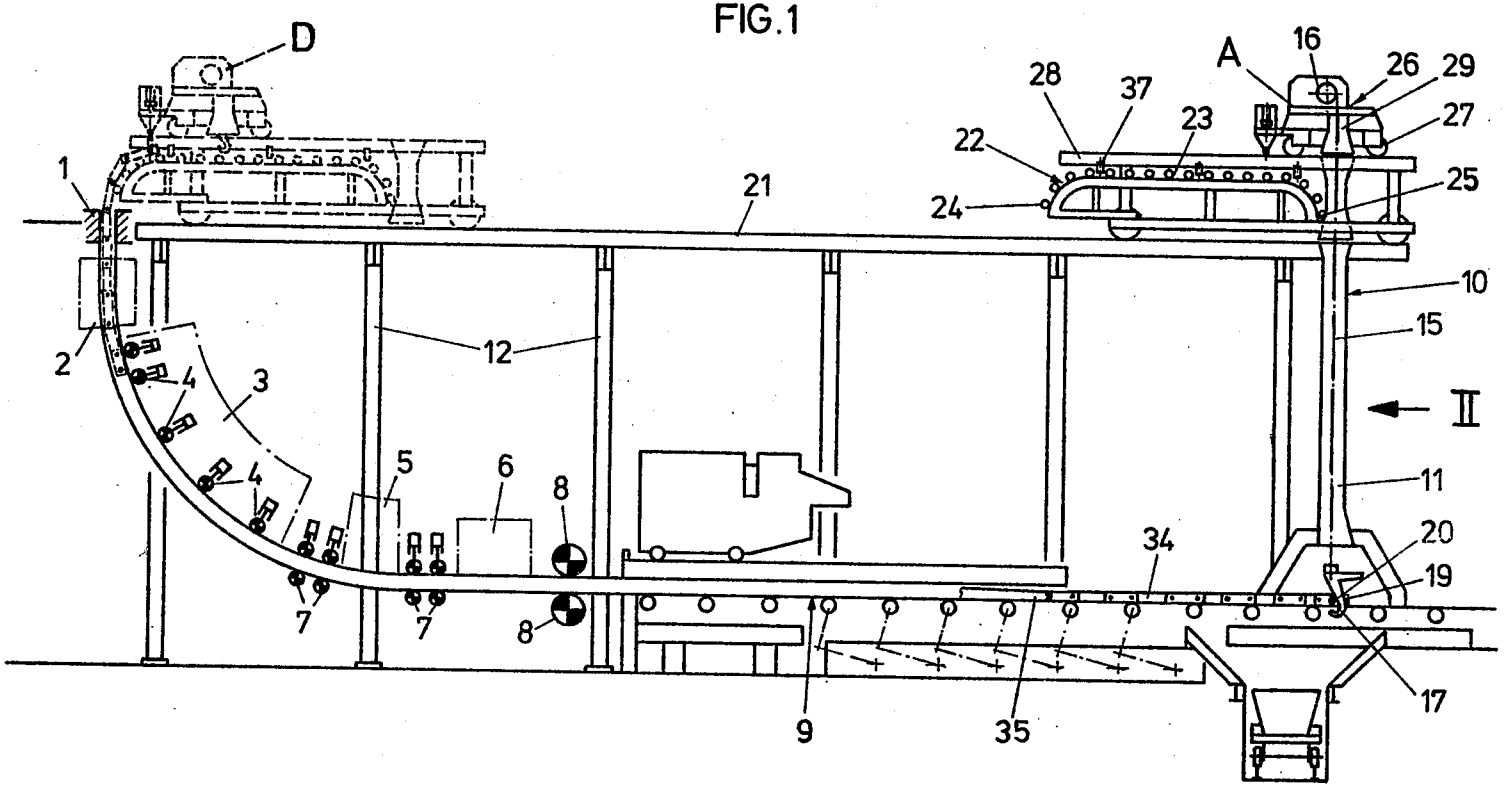
FIG. 1 is an overall view of the continuous casting plant in connection with an arrangement according to the invention which is mounted on the casting platform.

In FIG. 1, a continuous casting mould 1 is followed in the downward direction by a strand guide. In a bending zone 2 of the strand guide the cast strand is bent from the vertical to a circular arc. In a circular-arc-shaped guiding structure 3 following upon the bending zone, drivable rollers 4, which are adjustable to a starter bar, are mounted beside a number of non-driven rollers (not illustrated). The starter bar must be introduced into the strand guide from above through the mould to such an extent that the first drivable rollers grip it and convey it below. (In this position the starter bar is shown in the strand guide in broken lines). By means of a straightening zone 5 of the strand guide the circular-arc-shaped cast strand is straightened again. By reference number 6 a horizontal strand guide structure is denoted. Between the circular-arc-shaped part of the strand guide, the straightening zone and the horizontal strand guide structure, driving rollers 7 are provided. At the end of the horizontal guiding path there are further driving rollers 8. They are followed by the torch cutting roller path 9 provided with a torch cutting means at any desired position thereof, which torch cutting means cuts the cast strand into pieces of a desired length and also serves for cutting off the crop ends.

Figure 7:
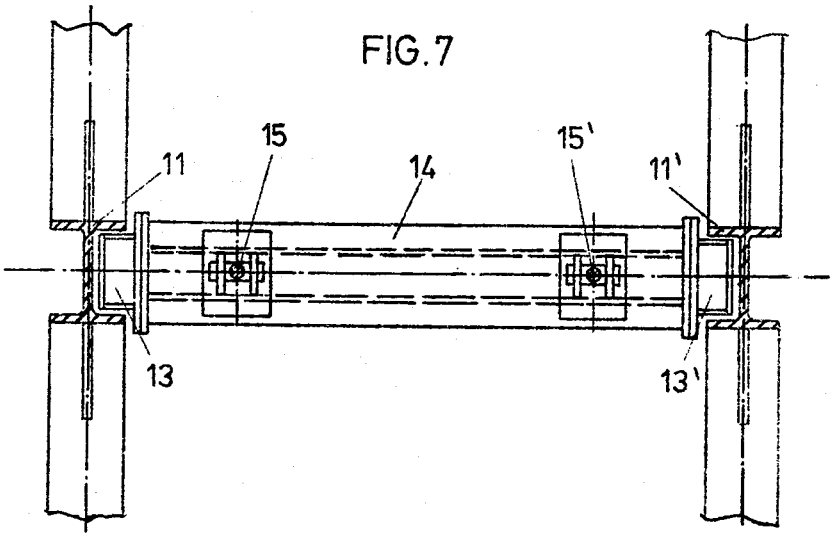
FIG. 7 is a section along line VII—VII of FIG. 2.

At the end of the torch cutting roller path there is a lifting means, generally denoted by 10. It comprises two stationary uprights 11 and 11' secured to the steel structure 12 of the plant. They have a U-shaped profile, as can be seen from FIG. 7. In this profile, the ends 13 and 13' of a tie-bar 14 are vertically guided. To the tie-bar two lifting cables or lifting chains 15 and 15' are secured, which cables are upwardly guided to a lifting mechanism 16. On the tie-bar there hangs a hook 17 which is pivotable about a bolt 18. By 19 the foot end of the starter bar is denoted, which foot end has a bolt 20.

On the casting platform (FIG. 1) a transporting car 22 is guided on rails 21, which transporting car is movable from the rear receiving position indicated in full lines into the introduction position at the mould, indicated in broken lines. On the transporting car 22 a sliding or roller path 23 is arranged, the front end 24 and rear end 25 of which are designed as quarter circles. Along the sliding or roller path 23, a displacement car generally denoted by 26 is movable to and fro in the longitudinal direction of the transporting car. In the example illustrated, the displacement car is guided with wheels 27 on rails 28 of the transporting car, which rails are arranged at both sides of the roller path.

Figure 5:
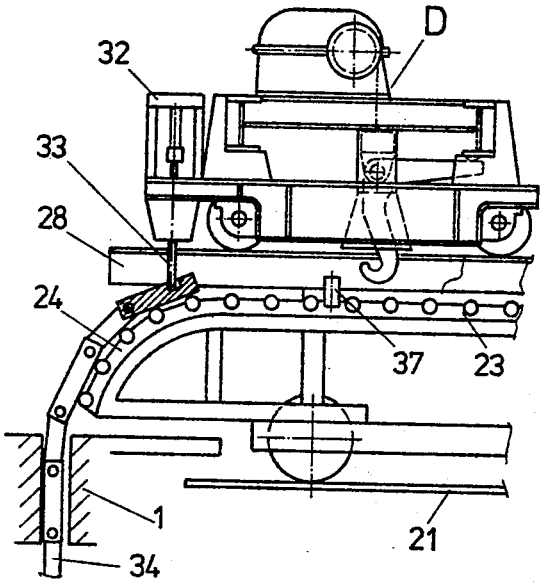

The displacement means contains a vertical guide 29 (FIG. 2), which corresponds to the stationary guide 11, i.e. which has the same U-shaped profile. Furthermore, a stop 30 is provided on the displacement car, which stop is contacted by a projection 31 of the hook 17 when the hook is in its uppermost position. The stop prevents a clockwise pivoting of the hook and, thus, an undesired unlatching of the book during the movement of the displacement car. Furthermore a catch means 32 is provided on the displacement car with a pin 33, that is liftable and lowerable via a drive that is actuated by hand or mechanically (FIG. 5).

The arrangement works in the following manner:

In FIG. 1, a starter bar 34 is illustrated lying on the torch cutting roller path 9. Its head is connected with the crop 35 of the hot strand e.g. by a tong-like connection. The longitudinal extension of the starter bar reaches from the crop 35 to the lifting means. In this position, the bolt 20 of the foot end of the starter bar has reached the mouth of the hook.

Figure 3:
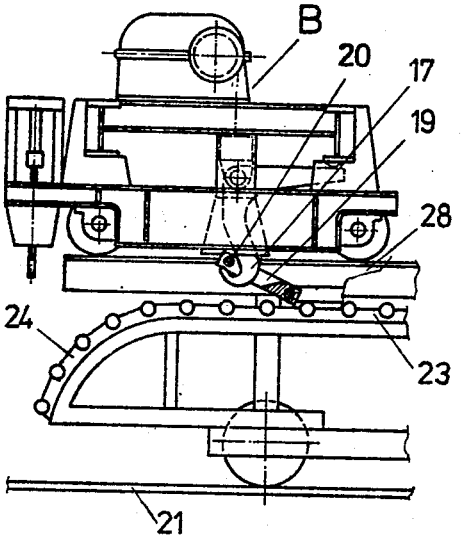
FIGS. 2 to 5 show side views of the displacement means in four different positions.
Figure 2:
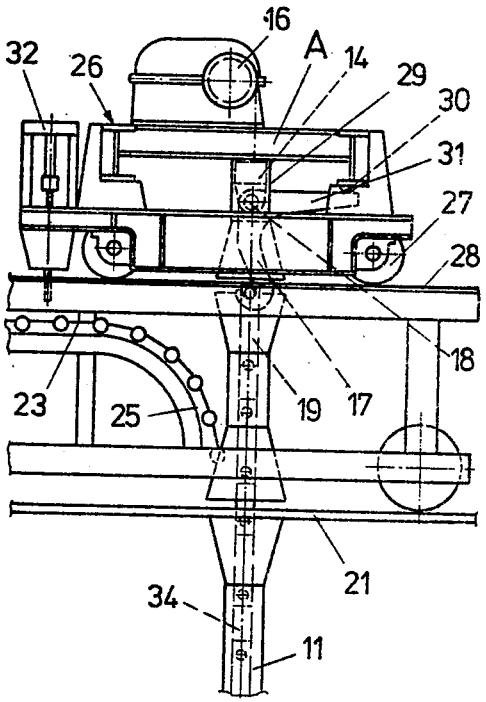

In the illustrations according to FIGS. 1, 2 and 3, the transporting car 22 is in the position indicated in full lines at the rear end of the transporting path, and in the illustrations according to FIGS. 1 and 2 the displacement car 26 is at the rear end of the transporting car. This position, the so-called starting position, is denoted by A. In this position the lifting mechanism is actuated via end switches or the like and the flexible starter bar 34 comprised of individual members is lifted until the hook 17 has been drawn into the guide 29 of the displacement car 26 (FIG. 2). During the lifting of the starter bar, the starter bar head is separated from the crop end. The displacement car 26, to which the hook 17 together with the foot end 19 of the starter bar are connected, is then moved in the longitudinal direction of the transporting car, whereby the starter bar is drawn onto the quarter-circle-shaped rear end 25 of the roller path and then is drawn over the horizontal part of the roller path of the transporting car. As soon as the displacement car has reached the position B according to FIG. 3, the last member at the foot end of the starter bar is pivoted up, e.g. by running over a link, and is thus unlatched from the hook 17. Then the transporting car 22 is moved to the mould where it reaches the position entered in FIG. 1 in broken lines.

Figure 4:
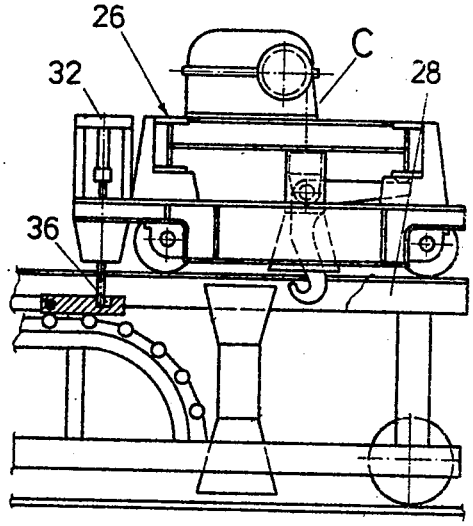
Figure 6:
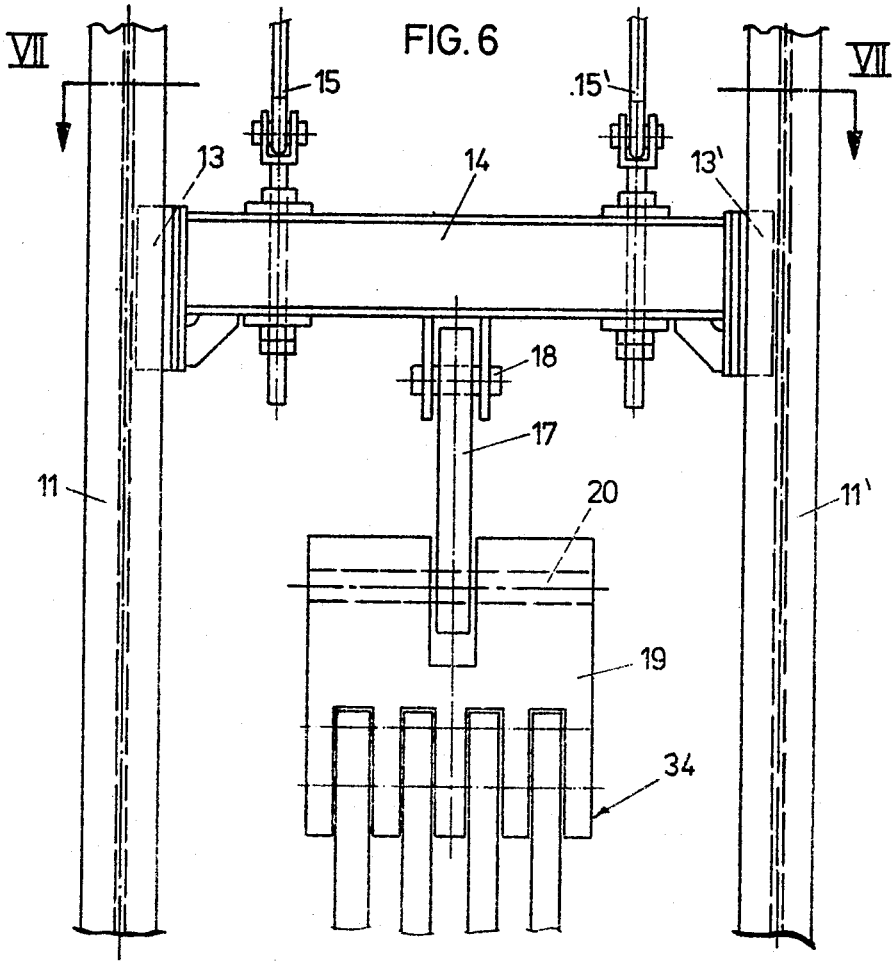
FIG. 6 is a partial view in the direction of the arrow II of FIG. 1, the hook of the lifting means being lifted.

This position is also illustrated in FIGS. 4 and 5. In the meantime, the displacement car has been moved to the rear end of the transporting car, as illustrated in FIG. 4, the catch 32 has been actuated and the pin or bolt 33 has been snapped into a recess 36 in the starter bar near the head end thereof. This intermediate or delivery position is denoted by C. Thereupon the displacement car is moved to the front end of the transporting car and the foot end of the starter bar is introduced into the mould via the quarter circle 24, until its foot part has reached the driven rollers and is held by them. After a decoupling of the catch the starter bar is drawn into the mould, until its head closes the bottom of the mould. Then the transporting car is moved away and casting can start.

The sliding or roller path 23 suitably is provided with vertical rollers 37 at both sides, which rollers laterally guide the starter bar.

According to a modified embodiment, the mould, and if desired also a strand guide part therebelow, can be removed before the starter bar is introduced into the strand guide.

I claim:

1. In an arrangement for introducing a flexible starter bar, having a head end, a foot end and a starter bar head, from above into a continuous casting plant of the type including a mould, a strand guide following the mould, an introduction part for introducing said starter bar into the strand guide, a lifting mechanism for gripping and lifting the starter bar, a transporting car provided with a sliding or roller path having an arcuate front end part and an arcuate rear end part, the starter bar being movable to the introduction part by the transporting car, and a conveying means for the starter bar provided on the transporting car, the improvement which is characterized in that the conveying means is designed as a displacement car located on the transporting car and being movable in the longitudinal direction of the sliding or roller path for introducing the starter bar into the introduction part, and first and second catch means provided on the displacement car to engage with the starter bar.

2. An arrangement as set forth in claim 1, wherein the introduction part for said starter bar is formed by the mould.

3. An arrangement as set forth in claim 1, further comprising rails provided on the transporting car, the displacement car being designed to be movable on said rails.

4. An arrangement as set forth in claim 1, wherein the lifting mechanism includes a lifting means and said lifting means is united with the displacement means.

5. An arrangement as set forth in claim 1, wherein the strand guide includes driven rollers, the first catch means is designed as a hook, the sliding or roller path is a horizontal sliding or roller path and the displacement car is movable along the horizontal sliding or roller path between (a) a starting position at the arcuate rear end part of the sliding or roller path, in which starting position the foot end of the starter bar has been lifted to the level of the sliding or roller path by the lifting mechanism, (b) a second position at the arcuate front end part of the sliding or roller path, in which second position the starter bar is on the sliding or roller path and the first catch means designed as a hook is disengageable from the starter bar, (c) a third position at the arcuate rear end part of the sliding or roller path, in which third position the second catch means is engageable in the head end of the starter bar, and (d) a final position reached after movement towards the mould at the arcuate front end part of the sliding or roller path, in which final position the foot end of the starter bar is gripped by the driven rollers of the strand guide.

6. An arrangement as set forth in claim 1, wherein the lifting mechanism includes a lifting means with a tie-bar and a stationary guide, the first catch means being designed as a hook and secured to said tie-bar, the tie-bar ends being guided in said guide, and wherein the displacement car is provided with a corresponding guide to accommodate the tie-bar together with the hook when in their lifted position, said corresponding guide being displaceable together with the displacement car.

7. An arrangement as set forth in claim 5, further comprising an unlatch means provided on the sliding or roller path in the second position of the displacement car for pivoting up the last foot member of the starter bar to disengage the starter bar from the first catch means.

8. An arrangement as set forth in claim 1, wherein said first catch means is designed as hook, a stop being provided on the displacement car to prevent a premature unlatching of the hook.

9. An arrangement as set forth in claim 1, further comprising lateral guiding elements provided along the sliding or roller path.

10. An arrangement as set forth in claim 9, wherein said lateral guiding elements are vertical rollers.

* * * * *

UNITED STATES PATENT OFFICE

CERTIFICATE OF CORRECTION

Patent No. 4,109,700 Dated Aug. 29, 1978

Inventor(s) Werner Scheurecker

It is certified that error appears in the above-identified patent and that said Letters Patent are hereby corrected as shown below:

Col. 1, line 8, after "head" insert a comma;

Col. 3, line 41, "clockwise" should read --counterclockwise--;
line 42, "book" should read --hook--; and
line 50, after "strand" insert a comma.

Signed and Sealed this

*Seventeenth* Day of *April 1979*

[SEAL]

*Attest:*

RUTH C. MASON
*Attesting Officer*

DONALD W. BANNER
*Commissioner of Patents and Trademarks*